US010030940B2

(12) United States Patent
Sheets, Jr.

(10) Patent No.: US 10,030,940 B2
(45) Date of Patent: Jul. 24, 2018

(54) FIREARM ACCESSORY ATTACHMENT CLAMP

(71) Applicant: Sig Sauer, Inc., Newington, NH (US)

(72) Inventor: Robert E. Sheets, Jr., Portland, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 15/401,408

(22) Filed: Jan. 9, 2017

(65) Prior Publication Data

US 2017/0205201 A1 Jul. 20, 2017

Related U.S. Application Data

(60) Provisional application No. 62/279,021, filed on Jan. 15, 2016.

(51) Int. Cl.
*F41G 11/00* (2006.01)

(52) U.S. Cl.
CPC ..... *F41G 11/003* (2013.01)

(58) Field of Classification Search
CPC ..... F41G 11/003
USPC ..... 42/90, 106, 124–128; 248/689
See application file for complete search history.

(56) References Cited

U.S. PATENT DOCUMENTS 5,806,228 A * 9/1998 Martel ..... F41G 11/003 42/124
2007/0180752 A1* 8/2007 Houde-Walter ..... F41G 11/003 42/114
2011/0271578 A1* 11/2011 Karagias ..... F41G 11/003 42/124
2012/0317854 A1* 12/2012 Nierenberg ..... F41C 23/06 42/1.06
2013/0000176 A1* 1/2013 Goertzen ..... F41G 11/003 42/90
2013/0061506 A1* 3/2013 Atkinson ..... F41G 11/003 42/90
2013/0312307 A1* 11/2013 Rorick ..... F41C 27/00 42/90
2015/0040456 A1* 2/2015 Zimmer ..... F41G 11/003 42/90

(Continued)

OTHER PUBLICATIONS

Steve Jenkins, Confirmed: Blackhawk SERPA CQC holster will Not fit a Sig Sauer P226 MK25, Oct. 4, 2012, Internet publication found here: https://www.stevejenkins.com/blog/2012/10/confirmed-blackhawk-serpa-cqc-holster-will-not-fit-a-sig-sauer-p226-mk25/, on Aug. 17, 2017, pp. 1 and 2.*

*Primary Examiner* — Bret Hayes
(74) *Attorney, Agent, or Firm* — Finch & Maloney, PLLC

(57) ABSTRACT

A compound mounting clamp is described that is configured for mounting an accessory (e.g., a laser sight, a telescopic sight, a bayonet, a light) to a firearm that includes either one of a Picatinny-type mounting rail or an arcuate mounting rail. The compound mounting clamp includes a clamp base with mounting surfaces that enable mounting to either one of a Picatinny-type mounting rail or the arcuate mounting rail. The mounting surfaces of the clamp base include: (1) two planar faces that are perpendicular to a first direction; and (2) two angled faces that are: (a) at an oblique angle with respect to the first direction; and (b) disposed between the two planar faces.

20 Claims, 4 Drawing Sheets

(56) References Cited

U.S. PATENT DOCUMENTS

2015/0068094 A1* 3/2015 Seuk ..... F41G 11/004
42/90

* cited by examiner

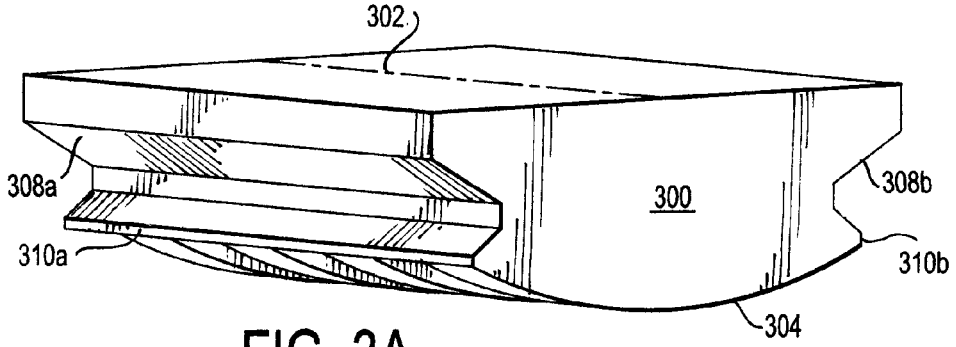
FIG. 3A
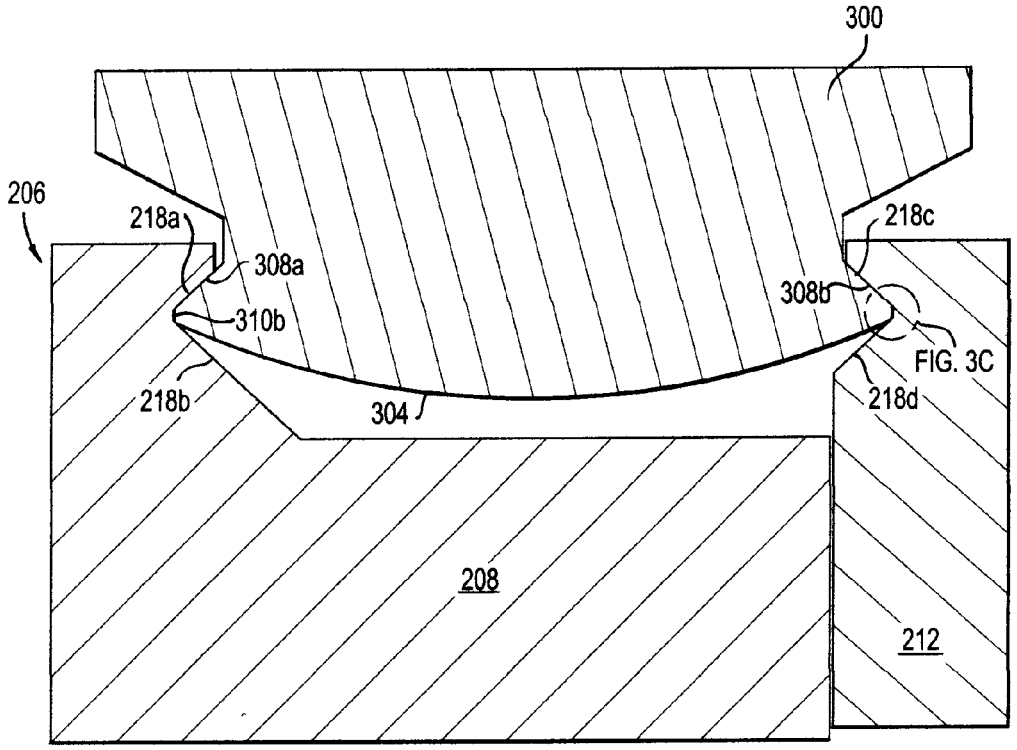
FIG. 3B
FIG. 3C
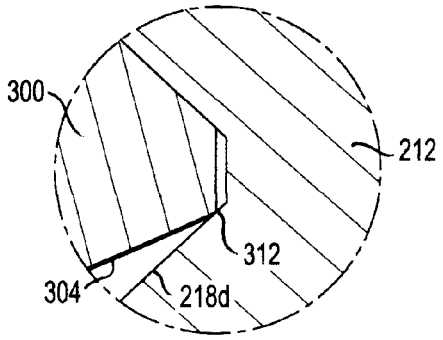

FIREARM ACCESSORY ATTACHMENT CLAMP

RELATED APPLICATIONS

This application claims priority under 35 USC § 119(e) to U.S. Provisional Patent Application No. 62/279,021 entitled "Firearm Accessory Attachment Clamp," filed on Jan. 15, 2016, which is incorporated by reference herein in its entirety.

TECHNICAL FIELD

The present disclosure relates generally to assemblies for attaching accessories to firearms. Specifically, the present disclosure is directed to a firearm accessory attachment clamp.

BACKGROUND

Firearm accessories, such as scopes, lights, grips, night vision devices, and bipods, are typically attached to a firearm using a standardized mounting feature. One type of standardized mounting feature is commonly referred to as a "rail." FIG. 1 illustrates a rail in a context of a sidearm. As shown, a sidearm 100 includes a rail 104 attached to an underside of a barrel assembly of the sidearm 100. The rail 104 enables an accessory having a clamp that is compatible with the rail 104 to be attached to the sidearm 100.

FIG. 2A illustrates one common configuration of a rail. The rail 204 shown in FIG. 2A is specified by U.S. Department of Defense standard number MIL-STD-1913 (also identified by North Atlantic Treaty Organization ("NATO") specification number STANAG 2324). This rail is more commonly known as a "1913 rail," or a "Picatinny rail." Another common configuration of a rail is a NATO accessory rail, identified by NATO specification number STANAG 4694. Similar in configuration to the "1913 rail," the NATO accessory rail is also colloquially identified by its acronym: "NAR." Regardless of the precise designation, the 1913 rail, NAR, and similarly configured rails, are collectively referred to herein as "Picatinny-type" rails.

A number of mounting clamps have been developed for mounting accessories to rails. Typically the mounting clamps are configured to mount to a single type of rail. These mounting clamps have an attachment mechanism for clamping the accessory securely to the mounting rail. An example of a mounting clamp attached to the 1913 rail is illustrated in FIG. 2B. As shown, the Picatinny rail 204 of FIG. 2A is placed within a clamp 206. The clamp 206 includes a base 208 and a sidewall 212. The base includes mounting faces 218*a*, 218*b*, 218*c*, and 218*d* (collectively 218), each of which is configured to mount to a confronting mounting face 216*a*, 216*b*, 216*c*, and 216*d* (collectively 216) of the Picatinny-type rail 204. A flat face 220 of the Picatinny rail 204 is disposed so as to have a gap separating the flat face 220 and the face 222 of the base 208. This is because the Picatinny rail 204 is configured to be secured into position within the clamp 206 by contact between angled faces 218 and 216.

While not shown, the NAR rail, similar in configuration to the 1913 rail, is configured to mount within a NAR-compatible clamp through contact with: (1) two angled mounting faces analogous to one each of mounting faces 216*a* and 216*b*, and mounting faces 216*c* and 216*d* of the rail 204 shown in FIG. 2A; and (2) a flat face analogous to the flat face 220 of the rail 204. In other words, the NAR rail is configured to mount within a corresponding clamp by contact at three faces (two angled mounting faces and a flat face) whereas the 1913 rail is configured to mount within a corresponding clamp by contact with four angled mounting faces.

SUMMARY

Embodiments of the present disclosure include a firearm accessory mounting clamp that includes a base, the base including: a first planar mounting face and a second planar mounting face, each of the first planar mounting face and the second planar mounting face orthogonal to a first axis; a first angled mounting face disposed between the first planar mounting face and the second planar mounting face, the first angled mounting face at a first oblique angle with respect to the first axis; a second angled mounting face disposed between the first planar mounting face and the second planar mounting face, the second angled mounting face at a second oblique angle with respect to the first axis. The firearm accessory mounting clamp also includes a sidewall releasable connected to the base. In some examples of this embodiment the first angled mounting face is adjacent to the first planar mounting face, and the second angled mounting face is adjacent to the second planar mounting face. In some examples of this embodiment, the first oblique angle and the second oblique angle have a same value. In some examples of this embodiment, at least one of the first oblique angle and the second oblique angle is from approximately 5° to approximately 10°. In some examples of this embodiment, the first planar mounting face and the second planar mounting face have a width of from approximately 5 mm to approximately 8 mm. In some examples of this embodiment, the sidewall is releasably connected to the base by a threaded bolt. In some examples of this embodiment, the firearm accessory mounting clamp further includes a trench disposed between the first angled mounting face and the second angled mounting face. In some examples of this embodiment, the first angled mounting face and the second angled mounting face are each configured to contact an arcuate surface of an arcuate mounting rail at a tangent.

Other embodiments of the present disclosure include a kit for a firearm accessory mounting clamp that includes a base, a sidewall configured for releasable connection to the base, and a fastener configured to releasably connect the sidewall to the base. The base includes a first planar mounting face and a second planar mounting face, each of the first planar mounting face and the second planar mounting face orthogonal to a first axis; a first angled mounting face disposed between the first planar mounting face and the second planar mounting face, the first angled mounting face at a first oblique angle with respect to the first axis; and a second angled mounting face disposed between the first planar mounting face and the second planar mounting face, the second angled mounting face at a second oblique angle with respect to the first axis. In some examples of this embodiment, the first angled mounting face is adjacent to the first planar mounting face, and the second angled mounting face is adjacent to the second planar mounting face. In some examples of this embodiment, the first oblique angle and the second oblique angle have a same value. In some examples of this embodiment, at least one of the first oblique angle and the second oblique angle is from approximately 5° to approximately 10°. In some examples of this embodiment, the first planar mounting face and the second planar mounting face have a width of from approximately 5 mm to approximately 8 mm. In some examples of this embodiment, the fastener is a threaded bolt. In some examples of this embodiment, the embodiment further includes a trench disposed between the first angled mounting face and the second angled mounting face. In some examples of this embodiment, the first angled mounting face and the second angled mounting face are each configured to contact an arcuate surface of an arcuate mounting rail at a tangent.

Still other embodiments of the present disclosure include a firearm system that includes a firearm including an accessory mounting rail, a firearm accessory mounting clamp, and an accessory attached to the firearm accessory mounting clamp. The firearm accessory mounting clamp includes: a first planar mounting face and a second planar mounting face, each of the first planar mounting face and the second planar mounting face orthogonal to a first axis; a first angled mounting face disposed between the first planar mounting face and the second planar mounting face, the first angled mounting face at a first oblique angle with respect to the first axis; a second angled mounting face disposed between the first planar mounting face and the second planar mounting face, the second angled mounting face at a second oblique angle with respect to the first axis; and a sidewall releasably connected to the base. In some examples of this embodiment, the accessory mounting rail is either one of a Picatinny-type mounting rail or an arcuate mounting rail. In some examples of this embodiment, the firearm accessory mounting clamp includes a trench disposed between the first angled mounting face and the second angled mounting face.

BRIEF DESCRIPTION OF THE DRAWINGS

FIG. 3A is a perspective view of an arcuate mounting rail.

FIG. 3B is a cross-sectional view of the arcuate mounting rail of FIG. 3A mounted within a Picatinny-type mounting clamp.

FIG. 3C is a close-up view of a contact point between an arcuate mounting rail mounted within the Picatinny-type mounting clamp, as shown in FIG. 3A.

FIG. 4B' is a close-up view of a mounting surface of a compound mounting clamp, in which an arcuate mounting rail is disposed in contact with an angled mounting face of the compound mounting clamp, in an embodiment of the present disclosure.

The figures depict various embodiments of the present disclosure for purposes of illustration only. One skilled in the art will readily recognize from the following discussion that arcuate embodiments of the structures and methods illustrated herein may be employed without departing from the principles described herein.

DETAILED DESCRIPTION

Overview

Embodiments of the present disclosure include a compound mounting clamp for mounting an accessory (e.g., a laser sight, a telescopic sight, a bayonet, a light) to a firearm that includes either one of a Picatinny-type mounting rail or an arcuate mounting rail, the latter of which is described below in more detail in the context of FIG. 3A. Embodiments of the compound mounting clamp described herein include a clamp base with mounting surfaces (alternatively referred to herein as "mounting faces" or simply "faces") that enable mounting to either one of a Picatinny-type mounting rail or an arcuate mounting rail. These mounting surfaces of the clamp base includes two planar faces that are perpendicular to a first direction. Between the two planar faces are two angled faces that are at an oblique angle with respect to the first direction; and that are disposed between the two planar faces.

Because compound mounting clamp embodiments of the present disclosure are configured to connect to either of a Picatinny-type mounting rail or the arcuate mounting rail described below, one benefit associated with embodiments of the present disclosure is a more versatile mounting system that can accommodate accessories from a broader range of manufacturers. Furthermore, in addition to this versatility, the compound mounting clamp embodiments of the present disclosure may be mounted to and removed from either of a Picatinny-type mounting rail or arcuate mounting rail without deforming, marring, or damaging rails of either of the rail types. Yet another advantage of embodiments of the present disclosure is an ability to remove and reattach an accessory from a firearm repeatably into a same location and same orientation, thus reducing the need to recalibrate or re-sight a previously attached accessory upon reattachment.

Arcuate Mounting Rail Mounted within a Picatinny-Type Mounting Clamp

Figure 2A:
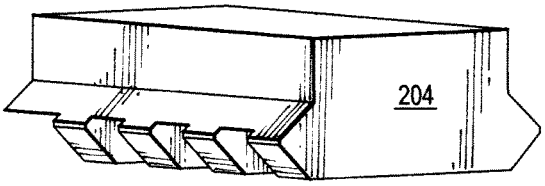
FIG. 2A (PRIOR ART)
FIG. 2A is a perspective view of a Picatinny mounting rail.

FIG. 3A is a perspective view of an arcuate mounting rail 300, examples of which include, but are not limited to, the SIG SAUER® mounting rail. The arcuate mounting rail 300 is configured for mounting with a corresponding clamp (not shown). As will be explained in more detail below, embodiments of mounting clamps of the present disclosure are able to mount with embodiments of the arcuate mounting rail 300 and are also able to mount with embodiments of Picatinny-type mounting rails, such as the Picatinny rail 204 shown in FIG. 2A.

Figure 1:
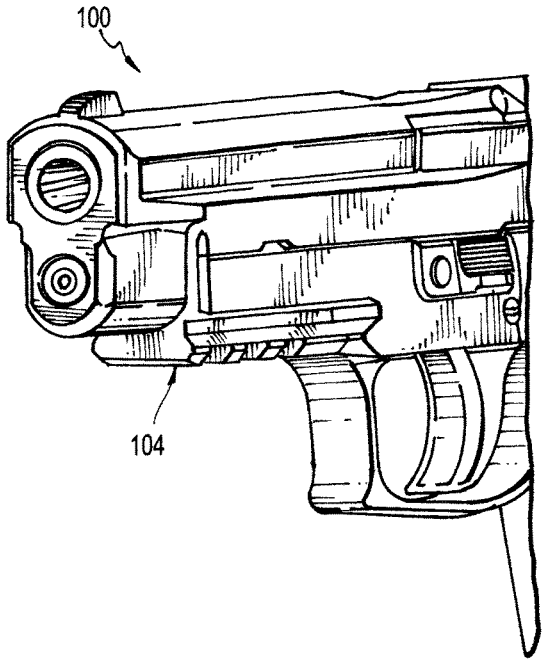
FIG. 1 (PRIOR ART)
FIG. 1 is a perspective view of a portion of a firearm, on which is disposed a Picatinny mounting rail.

The arcuate mounting rail 300 includes an arcuate face 304, planar mounting faces 308*a* and 308*b*, and faces 310*a* and 310*b*. A longitudinal axis 302 of the arcuate mounting rail 300 is also shown in FIG. 3A. The longitudinal axis 302 is, in most embodiments, disposed parallel to a barrel assembly of a firearm although this orientation is not required. As will be appreciated, with reference to FIG. 1 for example, a mounting rail of any configuration may be fabricated with, and thus integral to, the firearm itself. The firearm is omitted from FIG. 3A and the following figures for clarity of explanation.

The arcuate face 304 is a curved surface defined by a radius of curvature that is greater than 0 (i.e., the radius of curvature defines a curved, and not a flat, surface). This arcuate face 304 is different from Picatinny-type mounting rails, which generally include planar surfaces (as is evident upon inspection of FIG. 2A). In one embodiment, a radius of curvature of the arcuate face 304 is, in various embodiments, in any of the following ranges: from approximately 2 cm to approximately 50 cm; from approximately 2 cm to approximately 20 cm, from approximately 2 cm to approximately 10 cm, from approximately 5 cm to approximately 20 cm, from approximately 10 cm to approximately 20 cm, from approximately 10 cm to approximately 50 cm.

As is shown in FIG. 3A, each of the planar mounting faces 308*a* and 308*b* is substantially flat and each is disposed on an opposite side of the arcuate face 304 and on an opposed side of the longitudinal axis 302. A length of each of the planar mounting faces 308*a* and 308*b* is oriented to be parallel to the longitudinal axis 302 of the arcuate mounting rail 300. Similarly, faces 310*a* and 310*b* are each disposed at opposite sides of the arcuate face 304, at opposite sides of the longitudinal axis, and between the arcuate face 304 and the planar mounting faces 308*a* and 308*b*. With this orientation and configuration, the planar mounting faces 308*a* and 308*b* are configured to mate with, and provide a stable connection to, confronting faces of a corresponding mounting clamp (not shown). Generally, in mounting clamps specifically configured to receive the arcuate mounting rail 300, the arcuate face 304 does not have a corresponding mounting surface.

In some situations, a user will attach an accessory using a clamp configured for a first type of rail to a firearm having a second type of rail that is not compatible with the clamp of the first type. An example of this situation is shown in FIG. 3B, in which the arcuate mounting rail 300 has been mounted to a Picatinny-type mounting clamp 206. Because the Picatinny-type mounting clamp 206 is not configured to receive an arcuate mounting rail 300, some features of the arcuate rail 300 not intended to be used for mounting are contacted by portions of the Picatinny-type mounting clamp 206, thus degrading stability of the connection and potentially damaging the rail. For example, as shown in FIG. 3C for one side of the arcuate mounting rail 300, an edge 312 of each of the faces 310*a* and 310*b* contacts mounting faces 218*b* and 218*d*, respectively, of the Picatinny-type mounting clamp 206. This type of contact can deform the edge 312 of the arcuate mounting rail 300, impairing its ability to securely mount to an appropriately configured mounting clamp after removal from the Picatinny-type mounting clamp 206. Furthermore, the connection shown in FIGS. 3B and 3C is unlikely to be repeatable because of the low surface area contact along a line of contact (as opposed to a plane of contact across some or all of a mounting face) between the edge 312 and the face 218*d*. Thus, re-calibration of an accessory (e.g., a laser sight) is required each time the accessory is removed and subsequently re-attached to the rail. Also, if a rail is deformed from contact between the edge 312 and the Picatinny-type mounting clamp 206, it is even less likely that the connection between the rail and the clamp is stable and/or repeatable.

Compound Mounting Clamp

Figure 4A:
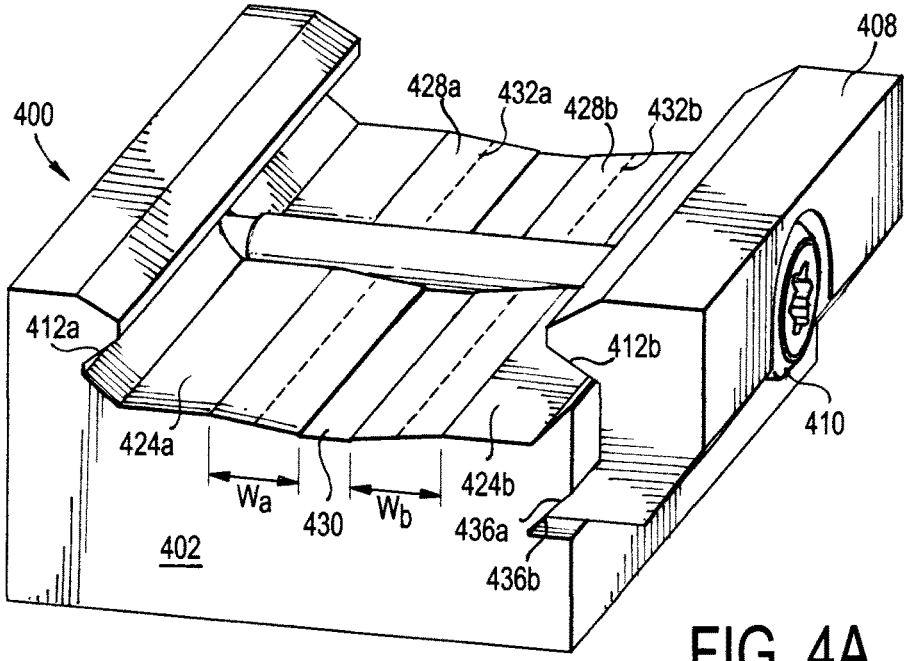
FIG. 4A is a perspective view of a compound mounting clamp configured to mount to either of a Picatinny-type mounting rail or an arcuate mounting rail, in an embodiment of the present disclosure.

To improve a quality (e.g., stability, repeatability, lack of damage) of mounting with either one of a Picatinny-type mounting rail (such as rail 204) or an arcuate mounting rail 300 (such as a SIG SAUER® mounting rail), a compound mounting clamp 400 is shown in FIGS. 4A, 4A', 4B, and 4C. FIG. 4A illustrates a perspective view of the compound mounting clamp 400 of the present disclosure. FIG. 4B illustrates a cross-sectional view of a compound mounting clamp 400 of the present disclosure mounted to an arcuate mounting rail 300. FIG. 4B' illustrates a magnified view of a portion of FIG. 4B. 4C illustrates a cross-sectional view of a compound mounting clamp 400 of the present disclosure mounted to a Picatinny-type mounting rail 204.

As shown in the perspective view of FIG. 4A, the compound mounting clamp 400 includes, at a high level, a base 402, a sidewall 408, and a fastener 410. The base 402 of the compound mounting clamp 400 includes side mounting faces 412*a* and 412*b*, a first planar mounting face 424*a* and a second planar mounting face 424*b* (collectively 424), a first angled mounting face 428*a* and a second angled mounting face 428*b* (collectively 428), and an optional trench 430.

The various mounting faces of the base 402 (side mounting faces 412*a*, 412*b*, a first planar mounting face 424*a*, a second planar mounting face 424*b*, a first angled mounting face 428*a*, and a second angled mounting face 428*b*) are configured so that either one of a Picatinny-type mounting rail 204 or an arcuate mounting rail 300 can securely and repeatably mount to a same location within the compound mounting clamp 400, reducing the need for re-calibration upon removal and replacement of an accessory. More specifically, the first and second planar mounting faces 424 and the first and second angled mounting faces 428 are configured so that the compound mounting clamp 400 can securely and repeatably mount to either one of a flat face 220 of a Picatinny-type rail 204 or an arcuate face 304 of an arcuate mounting rail 300.

As will be explained in more detail in the context of FIG. 4B, FIG. 4A also schematically illustrates lines of contact 432*a* and 432*b* along which the angled mounting faces 428*a* and 428*b* can contact some embodiments of the arcuate face 304 of an arcuate mounting rail 300. These illustration lines 432*a* and 432*b* are for clarity of explanation and do not limit the points or lines of contact between an embodiment of an arcuate face 304 and the angled mounting faces 428*a* and 428*b*. Rather, locations of the actual lines of contact on the angled mounting faces 428*a* and 428*b* will depend on the angle $\phi$ of the faces 428*a*, 428*b*, their corresponding widths $W_a$, $W_b$, and a radius of curvature of the arcuate face 304. All of these features are described below in more detail in the context of FIGS. 4B and 4B'.

FIG. 4B illustrates an embodiment of a compound mounting clamp 400 of the present disclosure mounted to an embodiment of an arcuate mounting rail 300 (as shown in FIG. 3A and described above). In this case, mounting occurs by confrontation of the arcuate mounting rail 300 with surfaces of the compound mounting clamp 400 that include side mounting faces 412*a*, 412*b*, the first angled mounting face 428*a*, and the second angled mounting face 428*b*. The confrontation of these various surfaces (along with the biasing by fastener 410 through the sidewall 408) creates at least three planes of contact that forms a secure and repeatable mount between the arcuate rail 300 and the compound mounting clamp 400. A first of the three planes of contact comes from mounting the side mounting face 412*a* of the base 402 of the compound mounting clamp 400 to the planar mounting face 308*a* of the arcuate mounting rail 300. A second plane of contact comes from contact between arcuate mounting rail 300 and both of the first angled mounting face 428*a* and the second angled mounting face 428*b*. The lines of contact between the arcuate mounting rail 300 and each of the angled mounting faces 428*a*, 428*b* are shown schematically as lines 432*a* and 432*b* in FIG. 4A. Because two geometric lines define a geometric plane, this contact creates a second plane of contact. A third plane of contact is formed between the planar mounting face 308*b* of the arcuate rail 300 and the side mounting face 412*b* of the sidewall 408 of the compound mounting clamp 400. As indicated above, the sidewall 408 is releasable through use of fastener 410, which is used to releasably bias the sidewall 408 toward the rail (regardless of the type of rail) to securely mount the rail and the clamp to one another.

Figure 2B:
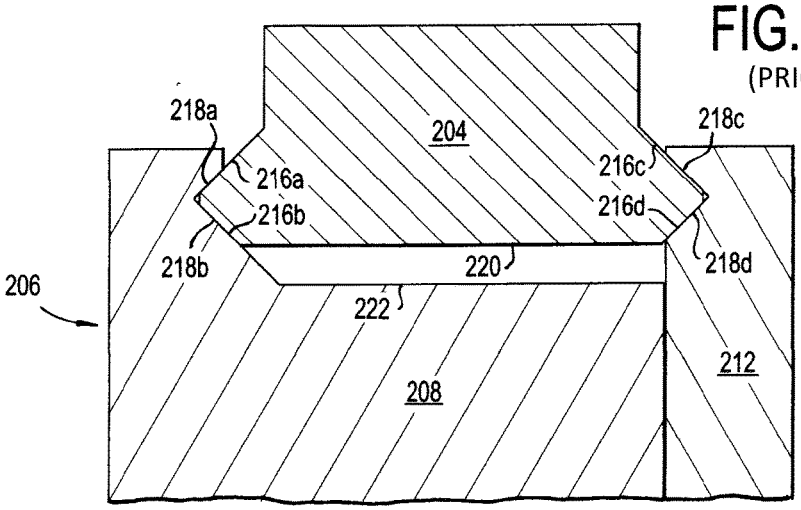
FIG. 2B (PRIOR ART)
FIG. 2B is a cross-sectional view of a Picatinny-type mounting rail mounted within a corresponding mounting clamp.

The side mounting faces 412*a* and 412*b* are analogous to those described above in the context of FIGS. 2B and 3B. These faces have angles and dimensions that are configured to mount to the corresponding faces of a Picatinny-type rail (e.g., a 1913 rail or a NAR) at a plane of contact (and not a line, such as that shown in FIG. 3C). These angles and dimensions are sufficient to also mount with planar contact to corresponding faces of the arcuate rail 300 shown in FIG. 3A.

The first angled mounting face 428*a* and the second angled mounting face 428*b* are configured for providing the second plane of contact between the clamp 400 and the arcuate mounting rail 300, as shown in FIG. 4B. Both of the first angled mounting face 428*a* and the second angled mounting face 428*b* form an oblique angle $\phi$ (i.e., greater than 90°) with the first axis, as shown in FIG. 4B'. The value of the oblique angle $\phi$ as well as the widths $W_a$ and $W_b$ of the angled mounting faces 428*a*, 428*b* are configured based on the possible ranges of the radius of curvature of arcuate face 304. Regardless of specific values, the first angled mounting face 428*a* and the second angled mounting face 428*b* are angled at oblique angle $\phi$ so that the angled mounting faces 428*a* and 428*b* are perpendicular to a radius of an arc defined by the arcuate face 304, and thus contacting the arcuate surface 304 at a tangent. Similarly, the oblique angle $\phi$ and the widths $W_a$ and $W_b$ of the angled mounting faces 428 are, in some embodiments, configured so that an arcuate mounting rail 300 contacts each of the angled mounting faces 428 approximately along a center line bisecting each of the angled mounting faces 428 and that is parallel to the longitudinal axis 302 of the arcuate mounting rail 300.

In one example, widths $W_a$ and $W_b$ are from approximately 5 mm to approximately 8 mm. In another example, widths $W_a$ and $W_b$ are from 8 mm to 12 mm. In some embodiments, the widths $W_a$ and $W_b$ are configured to be approximately the same. In one example, the oblique angle $\phi$ formed between a plane of one of the angled mounting faces 428 and the first axis is from approximately 95° to approximately 100°. In another example, the oblique angle $\phi$ formed between a plane of one of the angled mounting faces and the first axis is from approximately 100° to approximately 120°. In some embodiments, the oblique angle $\phi$ of each of the angled mounting faces 428 is the same, but in other embodiments the oblique angle $\phi$ corresponding to each of the angled mounting faces 428*a* and 428*b* are different from one another In the embodiments of the compound mounting clamp 400 shown in FIGS. 4A, 4B, and 4C, the first angled mounting face 428*a* and the second angled mounting face 428*b* are disposed between the first planar mounting face 424*a* and the second planar mounting face 424*b*. Also, the first angled mounting face 428*a* is adjacent to the first planar mounting face 424*a* and the second angled mounting face 428*b* is adjacent to the second planar mounting face 424*b*. In other embodiments, this particular configuration is not required. For example, other structures may be disposed between the planar mounting faces 424 and the angled mounting faces 428 in other embodiments. Also, in some embodiments the first and second planar mounting faces 424 are adjacent to corresponding angled mounting faces 428 along a shared boundary line (as shown in FIGS. 4B and 4B'), while in other embodiments other structures (such as additional angled mounting faces angled at an angle different from $\phi$) may be disposed between the planar mounting faces 424 and corresponding angled mounting faces 428.

Regardless, as indicated above, the first angled mounting face 428*a* and the second angled mounting face 428*b* are each dimensioned and configured contact the arcuate face 304 of the arcuate mounting rail 300 along a line approximately parallel to longitudinal axis 302 (such as lines 432*a* and 432*b*). These two lines of contact define a geometric plane, thus providing a plane of contact between the arcuate mounting rail 300 and the compound mounting clamp 400.

Optional trench 430 is depicted in FIG. 4A. The trench 430, when present in the compound mounting clamp 400, provides additional clearance so that the arcuate surface 304 of the arcuate mounting rail 300 may mount on each of the angled mounting faces 428*a*, 428*b*.

A secure mount between the compound mounting clamp 400 and either one of the a Picatinny-type mounting rail 204 or an arcuate mounting rail 300 is further facilitated by connecting sidewall 408 to the compound mounting clamp 400 via fastener 410. The sidewall 408 provides a side mounting face 412*b* to confront the mounting face 308*b* of the compound mounting clamp 400. The confrontation of these two surfaces 412*b* and 308*b* is analogous to the contact between surfaces 412*a* and 308*a* described above.

The sidewall 408 also includes a lower flange 436*b* that mounts to lower mounting surface 436*a* of the compound mounting clamp 400. The contact between surfaces 308*b* and 412*b* and the contact between surface 436*a* and lower flange 436*b* reduces the movement of the sidewall 408, and thus further enables a secure connection between the compound mounting clamp 400 and either one of the a Picatinny-type mounting rail 204 or an arcuate mounting rail 300.

An interference fit between surfaces 308*b* and 412*b* and between surface 436*a* and lower flange 436*b* is encouraged by using fastener 410 to apply a mechanical bias (i.e., a compressive force) between the sidewall 408 and the above-indicated surface of the compound mounting clamp 400 and Picatinny-type mounting rail 204 or an arcuate mounting rail 300. The fastener 410 shown in FIG. 4A is depicted as a threaded bolt, but other fasteners that apply a mechanical bias (and release the mechanical bias) to the sidewall 408 may also be used with equal effect.

Figure 4C:
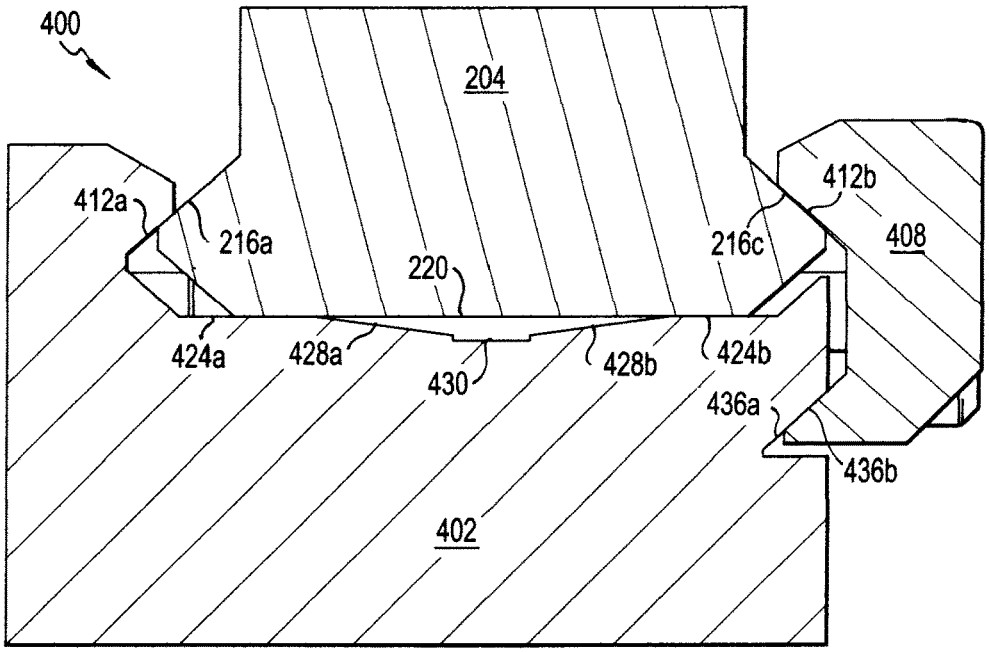
FIG. 4C is a cross-sectional view of a Picatinny-type mounting rail mounted within the compound mounting clamp of the present disclosure, in an embodiment.
Figure 4B:
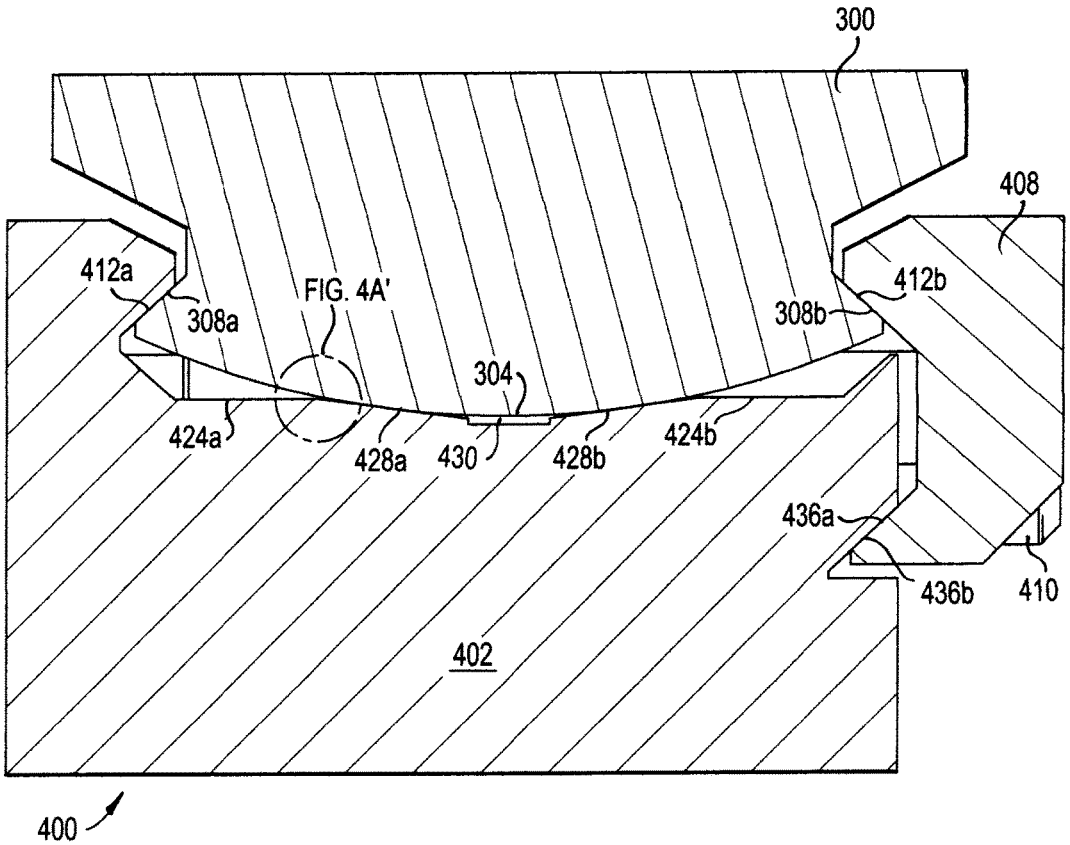
FIG. 4B is a cross-sectional view of a compound mounting clamp mounted to the arcuate mounting rail of FIG. 3A, in an embodiment of the present disclosure.
Figure 4B:
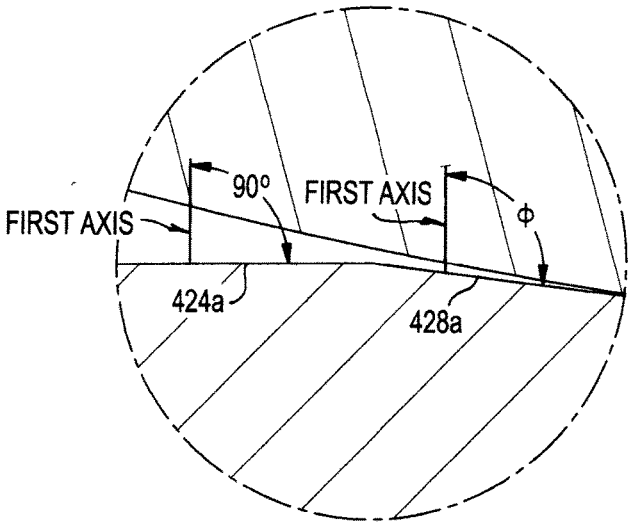

FIG. 4C illustrates a cross-sectional view of a compound mounting clamp 400 of the present disclosure in which a Picatinny-type (e.g., a 1913 rail, a NAR) mounting rail 204 is securely mounted. The mounting of the Picatinny-type mounting rail 204 within the compound mounting clamp 400 of the present disclosure is analogous to the mount with the arcuate mounting rail 300 presented above in FIG. 4A. The primary difference, however, is that the Picatinny-type mounting rail 204 mounts to first and second planar mounting faces 424*a* and 424*b*, respectively, rather than the angled mounting faces 428*a* and 428*b*.

Analogous to the depiction in FIG. 4A, the connection between the compound mounting clamp 400 and the Picatinny-type mounting rail 204 is defined by three planes of contact. The side mounting faces 412*a* and 412*b* of the compound mounting clamp 400 confront and mount to the mounting surfaces 216*a* and 216*c* of the Picatinny-type rail. These confronting surfaces define two planes of contact analogous to those described above. A third plane of contact that enables a stable and repeatable connection is defined by the first and second planar mounting faces 424*a* and 424*b*. That is, the flat face 220 of the Picatinny-type mounting rail 204 confronts and mounts to the first and second planar mounting faces 424*a* and 424*b* of the compound mounting clamp 400. This confrontation establishes the third plane of contact that substantially eliminates relative movement between the compound mounting clamp 400 and the Picatinny-type mounting rail 204 and facilitates removal and repeatable reconnection of the clamp 400 and rail 204.

Thus, as can be seen in FIGS. 4A-4C, a secure and repeatable mount to either one of a Picatinny-type mounting rail 204 or an arcuate mounting rail 300 is facilitated by embodiments of a compound mounting clamp 400 of the present disclosure. Regardless of the type of rail, three planes of contact are available within the compound mounting clamp 400.

SUMMARY

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A firearm accessory mounting clamp comprising:

a base comprising:

a first planar mounting face and a second planar mounting face, each of the first planar mounting face and the second planar mounting face orthogonal to a first axis;

a first angled mounting face that is flat and is disposed between the first planar mounting face and the second planar mounting face, the first angled mounting face at a first oblique angle with respect to the first axis;

a second angled mounting face that is flat and is disposed between the first planar mounting face and the second planar mounting face, the second angled mounting face at a second oblique angle with respect to the first axis; and a sidewall releasably connected to the base.

2. The firearm accessory mounting clamp of claim 1, wherein:

the first angled mounting face is adjacent to the first planar mounting face; and the second angled mounting face is adjacent to the second planar mounting face.

3. The firearm accessory mounting clamp of claim 1, wherein the first oblique angle and the second oblique angle have a same value.

4. The firearm accessory mounting clamp of claim 1, wherein at least one of the first oblique angle and the second oblique angle is from approximately 95° to approximately 100°.

5. The firearm accessory mounting clamp of claim 1, wherein the first planar mounting face and the second planar mounting face have a width of from approximately 5 mm to approximately 8 mm.

6. The firearm accessory mounting clamp of claim 1, wherein the sidewall is releasably connected to the base by a threaded bolt.

7. The firearm accessory mounting clamp of claim 1, further comprising a trench disposed between the first angled mounting face and the second angled mounting face.

8. The firearm accessory mounting clamp of claim 1, wherein the first angled mounting face and the second angled mounting face are each configured to contact an arcuate surface of an arcuate mounting rail at a tangent.

9. A kit for a firearm accessory mounting clamp comprising:

a base comprising:

a first planar mounting face and a second planar mounting face, each of the first planar mounting face and the second planar mounting face orthogonal to a first axis;

a first angled mounting face that is flat and is disposed between the first planar mounting face and the second planar mounting face, the first angled mounting face at a first oblique angle with respect to the first axis;

a second angled mounting face that is flat and is disposed between the first planar mounting face and the second planar mounting face, the second angled mounting face at a second oblique angle with respect to the first axis;

a sidewall configured for releasable connection to the base; and a fastener configured to releasably connect the sidewall to the base.

10. The firearm accessory mounting clamp of claim 9, wherein:

the first angled mounting face is adjacent to the first planar mounting face; and the second angled mounting face is adjacent to the second planar mounting face.

11. The firearm accessory mounting clamp of claim 9, wherein the first oblique angle and the second oblique angle have a same value.

12. The firearm accessory mounting clamp of claim 9, wherein at least one of the first oblique angle and the second oblique angle is from approximately 95° to approximately 100°.

13. The firearm accessory mounting clamp of claim 9, wherein the first planar mounting face and the second planar mounting face have a width of from approximately 5 mm to approximately 8 mm.

14. The firearm accessory mounting clamp of claim 9, wherein the fastener is a threaded bolt.

15. The firearm accessory mounting clamp of claim 9, further comprising a trench disposed between the first angled mounting face and the second angled mounting face.

16. The firearm accessory mounting clamp of claim 9, wherein the first angled mounting face and the second angled mounting face are each configured to contact an arcuate surface of an arcuate mounting rail at a tangent.

17. A firearm system comprising:

a firearm including an accessory mounting rail;

a firearm accessory mounting clamp configured for attachment to the accessory mounting rail, the firearm accessory mounting clamp comprising:

a first planar mounting face and a second planar mounting face, each of the first planar mounting face and the second planar mounting face orthogonal to a first axis;

a first angled mounting face that is flat and is disposed between the first planar mounting face and the second planar mounting face, the first angled mounting face at a first oblique angle with respect to the first axis;

a second angled mounting face that is flat and is disposed between the first planar mounting face and the second planar mounting face, the second angled mounting face at a second oblique angle with respect to the first axis;

a base;

a sidewall releasably connected to the base; and an accessory attached to the firearm accessory mounting clamp.

18. The firearm system of claim 17, wherein the accessory mounting rail is either one of a Picatinny-type mounting rail or an arcuate mounting rail.

19. The firearm system of claim 17, further comprising a trench disposed between the first angled mounting face and the second angled mounting face.

20. The firearm system of claim 17, wherein the first angled mounting face and the second angled mounting face are each configured to contact an arcuate surface of an arcuate mounting rail at a tangent.

* * * * *